United States Patent [19]

Mitchell

[11] 3,947,916

[45] Apr. 6, 1976

[54] TROWEL FOR MASONRY STEPS

[76] Inventor: Harold Mitchell, 210 NW. 56th St., Fort Lauderdale, Fla. 33308

[22] Filed: Nov. 21, 1974

[21] Appl. No.: 526,008

[52] U.S. Cl. ..... 15/235.8; 425/218; 425/458

[51] Int. Cl.[2] ..... E04F 21/16

[58] Field of Search..... 15/105.5, 235.3, 235.4, 15/235.5, 235.6, 235.7, 235.8; 401/193; 404/97, 98; 425/458

[56] References Cited

UNITED STATES PATENTS

| | | | |
|---|---|---|---|
| 1,548,452 | 8/1925 | Fyhrie | 404/97 |
| 2,674,117 | 4/1954 | Butler | 15/235.4 |
| 2,940,299 | 6/1960 | Sullivan | 15/235.4 X |
| 3,373,458 | 3/1968 | Haivala | 15/235.7 |

FOREIGN PATENTS OR APPLICATIONS

| | | | |
|---|---|---|---|
| 134,508 | 10/1949 | Australia | 15/235.6 |

*Primary Examiner*—Daniel Blum
*Attorney, Agent, or Firm*—Oltman and Flynn

[57] ABSTRACT

This is a tool for troweling masonry steps so as to provide a slight slope on the top of the step. A post is pivoted to the trowel blade near its front end, and it supports a roller for overlying engagement with the top of the riser form at the front of the next higher step. The roller is adjustable along the post to a height suitable for holding the front end of the trowel slightly elevated.

5 Claims, 6 Drawing Figures

Fig 1
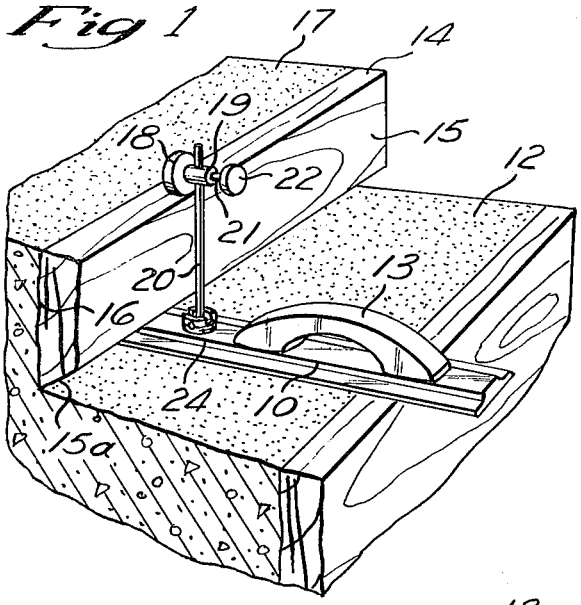
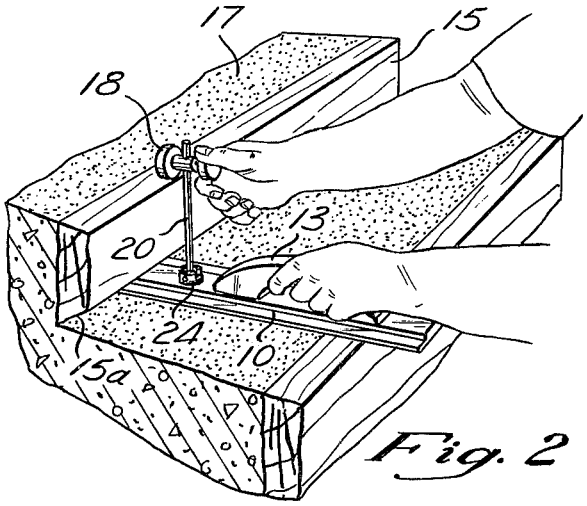
Fig. 2
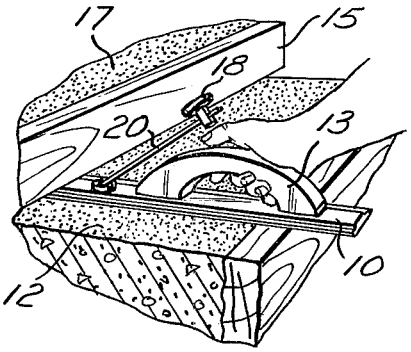
Fig. 3
Fig. 4
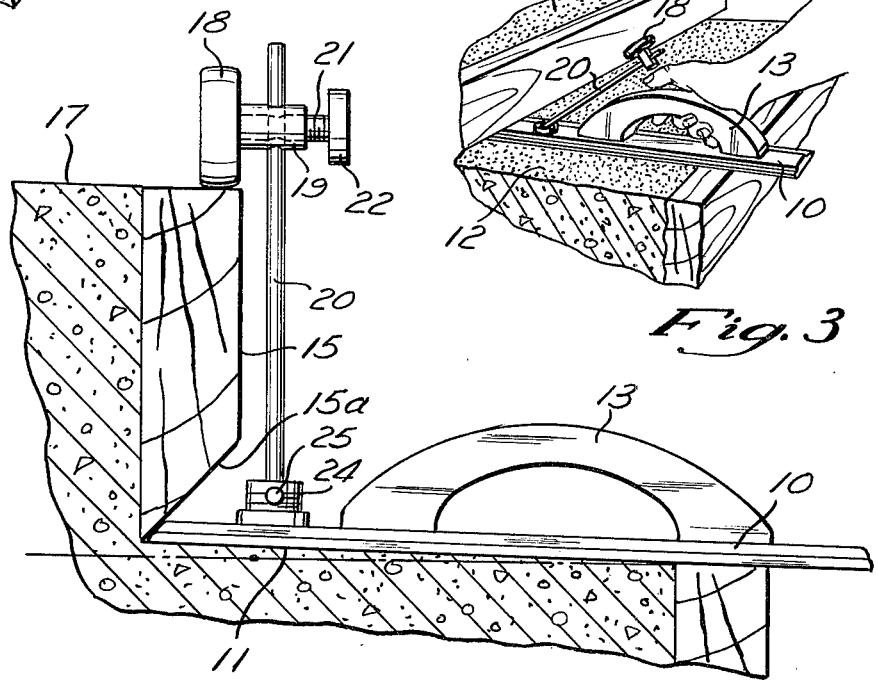
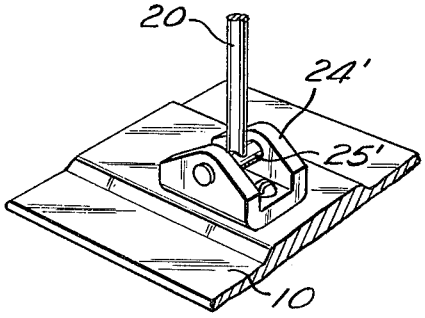
Fig. 5
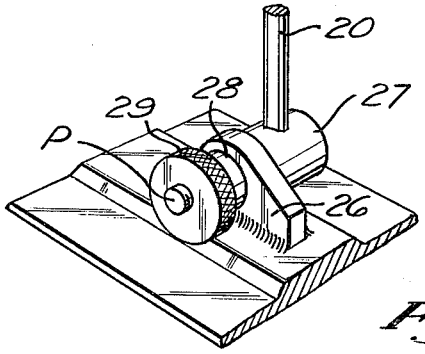
Fig. 6

TROWEL FOR MASONRY STEPS

BACKGROUND OF THE INVENTION

Masonry steps, particularly outside steps which are exposed to rain and snow, should be troweled so the top of each step has a slight downward inclination in a direction from the next higher step toward the next lower step, so that water will run off readily. In the past, the provision of such an inclination has depended upon the skill and attention devoted to the job by a workman using a conventional trowel. The results have not always been entirely satisfactory. Even where the results were satisfactory, this required considerable skill and careful attention by the workman and an appreciable amount of his time.

SUMMARY OF THE INVENTION

The present invention is directed to a tool for troweling masonry steps which has a novel and convenient arrangement for readily positioning the trowel blade with a slight inclination, so that the top of the step will have a slight downward slant toward the next lower step.

In the preferred embodiment, a post is pivoted on top of the trowel blade near one end for adjustment to an erected position extending up from the trowel blade. A roller carrier is slidably adjustable along the post. A roller is supported by this carrier for overlying rolling engagement with the top of a riser form at the front of the next higher step. The roller carrier is adjusted so that the underlying end of the trowel blade is raised slightly to impart the desired inclination to the top of the step that is being troweled as the roller rolls along the top of the riser form.

A principal object of this invention is to provide a novel and improved tool for troweling masonry steps to provide a slight inclination on the top of each step.

Another object of this invention is to provide such a tool having a novel arrangement for adapting it to steps of various heights.

Further objects and advantages of this invention will be apparent from the following detailed description of two presently-preferred embodiments, shown in the accompanying drawing in which:

FIG. 1 is a perspective view of the present tool before its use to trowel the top surface of a masonry step;

FIG. 2 is a similar view showing the tool being used by a workman;

FIG. 3 is a perspective view of the tool with the guide roller and its support retracted;

FIG. 4 is an end elevational view of the tool in its troweling position on a step;

FIG. 5 is a fragmentary perspective view showing an alternative pivoted attachment of the roller-supporting post on top of the trowel blade in the tool shown in FIGS. 1–4; and FIG. 6 is a similar view showing another alternative pivot arrangement for this post.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

Referring first to FIGS. 1 and 4, the present tool has a conventional elongated trowel blade 10 with a flat bottom face 11 for engagement with the top of a masonry step 12 before it has hardened. A handle 13 is attached to the trowel blade and extends above it longitudinally in the direction in which the blade is elongated.

In accordance with the present invention, a reference member is supported from the trowel blade to engage and ride over the flat top face 14 of a riser form 15 that engages the front 16 of the next higher step 17. Preferably, this reference member is a metal roller 18 which is rotatably mounted on a roller carrier in the form of a sleeve 19. In the operating position, as shown in FIGS. 1, 3 and 4, the roller 18 is supported for rotation about a horizontal axis that extends in the direction of elongation of the trowel blade 10 below.

The roller carrier sleeve 19 is formed with a cross bore which slidably receives a post 20 of circular cross section. A set screw 21 with a handle 22 is threadedly mounted in the opposite end of the sleeve 19 from where the roller 18 is located. This set screw is adjustable to clamp the sleeve 19 at any desired position along the post 20.

The lower end of the post 20 is pivotally mounted on the top of the trowel blade 10 for adjustment between a retracted position (FIG. 3) toward the trowel blade and overlying one end of the handle 13 and an erected position as shown in FIGS. 1, 2 and 4. The pivotal mounting in FIGS. 1–4 comprises a hollow threaded sleeve 24 screwed into a threaded opening in blade 10. A pivot pin 25 extends through post 20.

As shown in FIG. 5, this pivotal mounting may alternatively comprise a generally U-shaped bracket 24′, which is attached to the top of the trowel blade, and a cross pin 25′ on the lower end of the post 20, which is pivotally received in openings in the opposite upstanding legs of this bracket.

Alternatively, as shown in FIG. 6, the pivotal support for the lower end of the post 20 may comprise a bracket 26 which is welded to the top of the trowel blade and extends up from it, and a pivot assembly on the lower end of the post which is rotatably supported by bracket 26 and may be releasably clamped against it to lock the post in any desired angular position. This pivot assembly includes a pin P which is rotatably supported by the bracket 26, an enlarged hub 27 on one end of this pin and rigidly attached to the lower end of the post 20 at one side of bracket 26, and a sleeve 28 threadedly mounted on the pin P on the opposite side of bracket 26 and carrying a knurled knob 29. By turning this knob in one direction, the sleeve 28 and the hub 27 are brought into tight engagement with the opposite sides of the bracket to lock the post 20 against movement. By turning the knob in the opposite direction, this clamping engagement is released and the post may be pivoted about the axis of pin P.

In the use of this tool, the front end of the trowel blade 10 is inserted under the beveled bottom edge 15*a* of the riser form 15, as shown in FIG. 4, and with the post 20 erected the roller 18 is positioned in overlying engagement with the top 14 of this riser form. The position of the roller carrier 19 along the post 20 is adjusted so that the underlying front end of the trowel blade 15 will be raised slightly with respect to its opposite end. Consequently, the bottom face 11 of the trowel blade will have a slight upward inclination longitudinally in the direction toward the next higher step 17. The set screw 21 is tightened to hold the roller carrier 19 in this position. Now, by sliding the roller across the top 14 of the riser form 15 the step 12 that is being troweled will have its top face formed with a slight inclination downward away from the next higher step 17 and toward the next lower step.

The embodiment shown in FIGS. 1–4, generally requires the use of two hands, one to guide the roller 18 and the other to hold the handle 13 and move the trowel, as indicated in FIG. 2. This is because the lower end of post 20 is pivoted freely.

In the embodiment of FIG. 6, however, because the pivoted lower end of the support post 20 may be releasably clamped in the erected position, the tool may be used with just one hand on the handle 13.

From the foregoing, it will be evident that the present tool enables the flat bottom face 11 of the trowel blade 10 to be positively positioned at the desired distance below the top 14 of the riser form 15 in front of the next higher step and guided at the desired inclination for producing a downward slant of the top of the step being troweled in the direction toward the next lower step. This tool enables the workman to trowel the steps at a faster speed and with greater ease than if he were using a trowel lacking such a positive positioning and guiding arrangement.

I claim:

1. A tool for troweling masonry steps comprising:

a trowel blade for troweling the surface of a step;

a substantially rigid support extending up from said blade near one end of the latter;

a reference member carried by said support and positioned beyond said support in the direction of said one end of the trowel blade for overlying engagement with the top of a riser form in front of the next higher step to impart a slight upward inclination to the trowel blade in the direction of said one end as said reference member rides over the top of said riser form;

said support comprising a post pivotally mounted at its lower end on said blade for adjustment between a retracted position toward the blade and an erected position extending up from the blade;

a carrier for the reference member projecting endwise from said post and supporting the reference member beyond said post in said one direction when the post is in its erected position, said carrier being slidably adjustable lengthwise along said post;

and means for releaseably locking said carrier at a selected position along the post corresponding to the desired spacing of the reference member vertically above the blade.

2. A tool according to claim 1, wherein said reference member is a roller rotatably carried by said support.

3. A tool for troweling masonry steps comprising:

a trowel blade for troweling the surface of the step;

a substantially rigid support extending up from said blade near one end of the latter;

a reference member carried by said support and positioned beyond said support in the direction of said one end of the trowel blade for overlying engagement with the top of a riser form in front of the next higher step to impart a slight upward inclination to the trowel blade in the direction of said one end as said reference member rides over the top of said riser form;

said reference member comprising a roller rotatably carried by said support;

and said support comprising a post pivotally mounted at its lower end on said blade for adjustment between a retracted position toward the blade and an erected position extending up from the blade;

and a roller carrier projecting endwise from said post and rotatably supporting the roller beyond said post in said one direction when the post is in its erected position.

4. A tool according to claim 3, wherein said roller carrier is slidably adjustable lengthwise along said post, and further comprising means for releasably locking said roller carrier at a selected position along the post corresponding to the desired spacing of the roller vertically above the blade.

5. A tool for troweling masonry steps comprising:

an elongated trowel blade for troweling the surface of a step, a handle on the blade extending longitudinally across the top of the blade;

a post extending up from the blade between the handle and one end of the blade;

a roller carrier mounted on said post above the trowel blade;

and a roller rotatably carried by said carrier at the opposite side of the post from said handle for overlying rolling engagement with the top of a riser form in front of the next higher step;

said post being pivotally mounted at its lower end on said trowel blade for adjustment between a retracted position toward the blade and an erected position projecting up from the blade;

said carrier projecting from said post in the direction of said one end of the blade and being slidably adjustable lengthwise along the post; and means for releasably locking said carrier at a selected position along the post corresponding to the desired spacing of the roller above the blade.

* * * * *